US010657897B2

(12) United States Patent
Chen et al.

(10) Patent No.: US 10,657,897 B2
(45) Date of Patent: May 19, 2020

(54) DRIVING COMPENSATION CIRCUIT FOR OLED DISPLAY UNIT, OLED DISPLAY CIRCUIT, AND OLED DISPLAY

(71) Applicant: Shenzhen China Star Optoelectronics Semiconductor Display Technology Co., Ltd., Shenzhen, Guangdong (CN)

(72) Inventors: Xiaolong Chen, Guangdong (CN); Hongjun Xie, Guangdong (CN)

(73) Assignee: Shenzhen China Star Optoelectronics Semiconductor Display Technology Co., Ltd., Shenzhen, Guangdong (CN)

( * ) Notice: Subject to any disclaimer, the term of this patent is extended or adjusted under 35 U.S.C. 154(b) by 0 days.

(21) Appl. No.: 16/078,045

(22) PCT Filed: May 7, 2018

(86) PCT No.: PCT/CN2018/085905

§ 371 (c)(1),
(2) Date: Aug. 21, 2018

(87) PCT Pub. No.: WO2019/192049

PCT Pub. Date: Oct. 10, 2019

(65) Prior Publication Data

US 2019/0311677 A1 Oct. 10, 2019

(51) Int. Cl.
*G09G 3/3258* (2016.01)

(52) U.S. Cl.
CPC ... *G09G 3/3258* (2013.01); *G09G 2300/0819* (2013.01); *G09G 2320/0233* (2013.01); *G09G 2320/045* (2013.01)

(58) Field of Classification Search
None
See application file for complete search history.

(56) References Cited

U.S. PATENT DOCUMENTS

| | | | | |
|---|---|---|---|---|
| 2014/0176625 | A1* | 6/2014 | Yoon | G09G 3/3233 345/691 |
| 2016/0078805 | A1* | 3/2016 | Woo | G09G 3/3225 345/78 |
| 2016/0125807 | A1* | 5/2016 | Wang | G09G 3/3258 |
| 2019/0103059 | A1* | 4/2019 | Yang | G09G 3/3258 |

FOREIGN PATENT DOCUMENTS

| | | | |
|---|---|---|---|
| CN | 104036722 | A | 9/2014 |
| CN | 105427796 | A | 3/2016 |
| CN | 107039004 | A | 8/2017 |
| CN | 107610643 | A | 1/2018 |

* cited by examiner

*Primary Examiner* — Kenneth B Lee, Jr.
(74) *Attorney, Agent, or Firm* — Mark M. Friedman

(57) ABSTRACT

The present invention provides a driving compensation circuit for an organic light-emitting diode (OLED) display unit. The OLED display unit includes: N first switching transistors, N second switching transistors, N sensing units, and a calculation and processing unit. The calculation and processing unit is configured to calculate a mapping relationship between a data voltage of the data line and current information, and to calculate a data compensation voltage in a display phase according to second current information and the mapping relationship.

20 Claims, 1 Drawing Sheet

DRIVING COMPENSATION CIRCUIT FOR OLED DISPLAY UNIT, OLED DISPLAY CIRCUIT, AND OLED DISPLAY

BACKGROUND

Technical Field

The present invention relates to the liquid crystal display field, and specifically, to a driving compensation circuit for an organic light-emitting diode (OLED) display unit, an OLED display circuit, and an OLED display.

Related Art

Due to instability in a panel process or other reasons, a threshold voltage of a driver thin film transistor of each pixel in a panel differs. Therefore, even if a same data voltage is applied to the driver thin film transistor of each pixel, a case in which currents flow into an OLED are different may occur. Consequently, it is difficult to achieve uniformity of image display quality.

In addition, with the passage of a driving time of the driver thin film transistor, material aging and variation are caused to the thin film transistor, leading to a problem of a drift of the threshold voltage of the driver thin film transistor or the like. In addition, different degrees of aging of materials of the thin film transistor in the panel lead to different drifts of threshold voltages of various driver thin film transistors in the panel. Further, a phenomenon of non-uniform display of the panel is caused. Moreover, with the passage of the driving time, severer material aging of the thin film transistor is caused. Even if drive voltages are the same, glow currents flowing through the OLED are very likely to be different, leading to non-uniform brightness.

Therefore, the prior art has a disadvantage and needs to be improved urgently.

SUMMARY

An objective of embodiments of the present invention is to provide a driving compensation circuit for an OLED display unit, an OLED display circuit, and an OLED display, to make display of the OLED display more uniform.

An embodiment of the present invention provides a driving compensation circuit for an OLED display unit. The OLED display unit includes M rows and N columns of pixel units, where each column of pixel units is connected to a data line, and each row of pixel units is connected to a scanning line. The compensation circuit includes N first switching transistors, N second switching transistors, N sensing units, and a calculation and processing unit.

An input end of each first switching transistor is connected to a voltage input end of each pixel unit in a column of pixel units, where N is a positive integer.

An output end of each second switching transistor is connected to a voltage input end of each pixel unit in a column of pixel units.

The N sensing units are connected to the output ends of the N first switching transistors in a one-to-one corresponding manner. The sensing unit is configured to acquire first current information in sensing mode and second current information in display mode that are of a voltage input end of each pixel unit.

The calculation and processing unit is connected to the N sensing units and the data line. The calculation and processing unit is configured to calculate a mapping relationship between a data voltage of the data line and the current information, and to calculate a data compensation voltage in a display phase according to the second current information and the mapping relationship.

On/off states of a first switching transistor and a second switching transistor that are connected to a same column of pixel units are opposite.

The sensing unit includes a first PMOS transistor and a second PMOS transistor. A source of the first PMOS transistor is connected to an output end of a corresponding first switching transistor. A gate of the first PMOS transistor is connected to the source of the first PMOS transistor. A gate of the second PMOS transistor is connected to the gate of the first PMOS transistor. Drains of the first PMOS transistor and the second PMOS transistor are connected to a power supply end; and a source of the second PMOS transistor is connected to the calculation and processing unit.

The calculation and processing unit includes a gating module, an analog to digital converter, and a processing chip. An input end of the gating module is connected to the sensing units. An output end of the gating module is connected to the analog to digital converter. The analog to digital converter is connected to the processing chip.

In the driving compensation circuit for an OLED display unit in the present invention, in the sensing mode, the first switching transistors are all in a conducted state, and the second switching transistors are all in a cut-off state; the gating module sequentially conducts the sensing units to the analog to digital converter; the analog to digital converter converts the current information into a digital signal; and the processing chip calculates a mapping relationship between a voltage compensation value and a current value according to the digital signal.

In the driving compensation circuit for an OLED display unit in the present invention, in the display mode, the first switching transistors are all in a cut-off state, and the second switching transistors are all in a conducted state; and the compensation unit outputs a compensated voltage to the power input end.

In the driving compensation circuit for an OLED display unit in the present invention, the first switching transistor and the second switching transistor are both PMOS transistors.

In the driving compensation circuit for an OLED display unit in the present invention, the first switching transistor and the second switching transistor are both NMOS transistors.

In the driving compensation circuit for an OLED display unit in the present invention, the driving compensation circuit for an OLED display unit further includes a gate control unit. The gate control unit is connected to gates of the first switching transistor and the second switching transistor, to control on/off states of the first switching transistor and the second switching transistor.

An embodiment of the present invention further provides a driving compensation circuit for an OLED display unit. The OLED display unit includes M rows and N columns of pixel units, where each column of pixel units is connected to a data line, and each row of pixel units is connected to a scanning line. The compensation circuit includes N first switching transistors, N second switching transistors, N sensing units, and a calculation and processing unit.

An input end of each first switching transistor is connected to a voltage input end of each pixel unit in a column of pixel units, where N is a positive integer.

An output end of each second switching transistor is connected to a voltage input end of each pixel unit in a column of pixel units.

The N sensing units are connected to the output ends of the N first switching transistors in a one-to-one corresponding manner. The sensing unit is configured to acquire first current information in sensing mode and second current information in display mode that are of a voltage input end of each pixel unit.

The calculation and processing unit is connected to the N sensing units, and the data line. The calculation and processing unit is configured to calculate a mapping relationship between an initial data voltage of the data line and the current information, and to calculate a data compensation voltage in a display phase according to the second current information and the mapping relationship.

On/off states of a first switching transistor and a second switching transistor that are connected to a same column of pixel units are opposite.

In the driving compensation circuit for an OLED display unit in the present invention, the sensing unit includes a first PMOS transistor and a second PMOS transistor. A source of the first PMOS transistor is connected to an output end of a corresponding first switching transistor. A gate of the first PMOS transistor is connected to the source of the first PMOS transistor. A gate of the second PMOS transistor is connected to the gate of the first PMOS transistor. Drains of the first PMOS transistor and the second PMOS transistor are connected to a power supply end. A source of the second PMOS transistor is connected to the calculation and processing unit.

In the driving compensation circuit for an OLED display unit in the present invention, the calculation and processing unit includes a gating module, an analog to digital converter, and a processing chip. An input end of the gating module is connected to the sensing units. An output end of the gating module is connected to the analog to digital converter. The analog to digital converter is connected to the processing chip.

In the driving compensation circuit for an OLED display unit in the present invention, in the sensing mode, the first switching transistors are all in a conducted state, and the second switching transistors are all in a cut-off state; the gating module sequentially conducts the sensing units to the analog to digital converter; the analog to digital converter converts the current information into a digital signal; and the processing chip calculates a mapping relationship between a voltage compensation value and a current value according to the digital signal.

In the driving compensation circuit for an OLED display unit in the present invention, in the display mode, the first switching transistors are all in a cut-off state, and the second switching transistors are all in a conducted state; and the compensation unit outputs a compensated voltage to the power input end.

In the driving compensation circuit for an OLED display unit in the present invention, the first switching transistor and the second switching transistor are both PMOS transistors.

In the driving compensation circuit for an OLED display unit in the present invention, the first switching transistor and the second switching transistor are both NMOS transistors.

In the driving compensation circuit for an OLED display unit in the present invention, the driving compensation circuit for an OLED display unit further includes a gate control unit. The gate control unit is connected to gates of the first switching transistor and the second switching transistor, to control on/off states of the first switching transistor and the second switching transistor.

An OLED display circuit includes a driving compensation circuit for an OLED display unit. The OLED display unit includes M rows and N columns of pixel units, where each column of pixel units is connected to a data line, and each row of pixel units is connected to a scanning line. The compensation circuit includes N first switching transistors, N second switching transistors, N sensing units, and a calculation and processing unit.

An input end of each first switching transistor is connected to a voltage input end of each pixel unit in a column of pixel units, where N is a positive integer.

An output end of each second switching transistor is connected to a voltage input end of each pixel unit in a column of pixel units.

The N sensing units are connected to the output ends of the N first switching transistors in a one-to-one corresponding manner. The sensing unit is configured to acquire first current information in sensing mode and second current information in display mode that are of a voltage input end of each pixel unit.

The calculation and processing unit is connected to the N sensing units, and the data line. The calculation and processing unit is configured to calculate a mapping relationship between a data voltage of the data line and the current information, and to calculate a data compensation voltage in a display phase according to the second current information and the mapping relationship.

On/off states of a first switching transistor and a second switching transistor that are connected to a same column of pixel units are opposite.

In the OLED display circuit in the present invention, the sensing unit includes a first PMOS transistor and a second PMOS transistor. A source of the first PMOS transistor is connected to an output end of a corresponding first switching transistor. A gate of the first PMOS transistor is connected to the source of the first PMOS transistor. A gate of the second PMOS transistor is connected to the gate of the first PMOS transistor. Drains of the first PMOS transistor and the second PMOS transistor are connected to a power supply end. A source of the second PMOS transistor is connected to the calculation and processing unit.

In the OLED display circuit in the present invention, the calculation and processing unit includes a gating module, an analog to digital converter, and a processing chip. An input end of the gating module is connected to the sensing units. An output end of the gating module is connected to the analog to digital converter. The analog to digital converter is connected to the processing chip.

In the OLED display circuit in the present invention, in the sensing mode, the first switching transistors are all in a conducted state, and the second switching transistors are all in a cut-off state; the gating module sequentially conducts the sensing units to the analog to digital converter; the analog to digital converter converts the current information into a digital signal; and the processing chip calculates a mapping relationship between a voltage compensation value and a current value according to the digital signal.

In the OLED display circuit in the present invention, in the display mode, the first switching transistors are all in a cut-off state, and the second switching transistors are all in a conducted state; and the compensation unit outputs a compensated voltage to the power input end.

In the OLED display circuit in the present invention, the first switching transistor and the second switching transistor are both PMOS transistors.

An OLED display includes the driving compensation circuit for an OLED display unit described above.

According to the driving compensation circuit for an OLED display unit, the OLED display circuit, and the OLED display that are provided in the present invention, a mapping relationship between a voltage compensation value to be output to each pixel unit and an input current value is calculated, to compensate for each pixel unit, so that uniformity of the OLED display can be improved.

BRIEF DESCRIPTION OF THE DRAWINGS

To describe the technical solutions in the embodiments of the present invention more clearly, the following briefly describes the accompanying drawings required for describing the embodiments. Apparently, the accompanying drawings in the following description show merely some embodiments of the present invention, and a person skilled in the art may still derive other drawings from these accompanying drawings without creative efforts.

DETAILED DESCRIPTION

Figure 1:
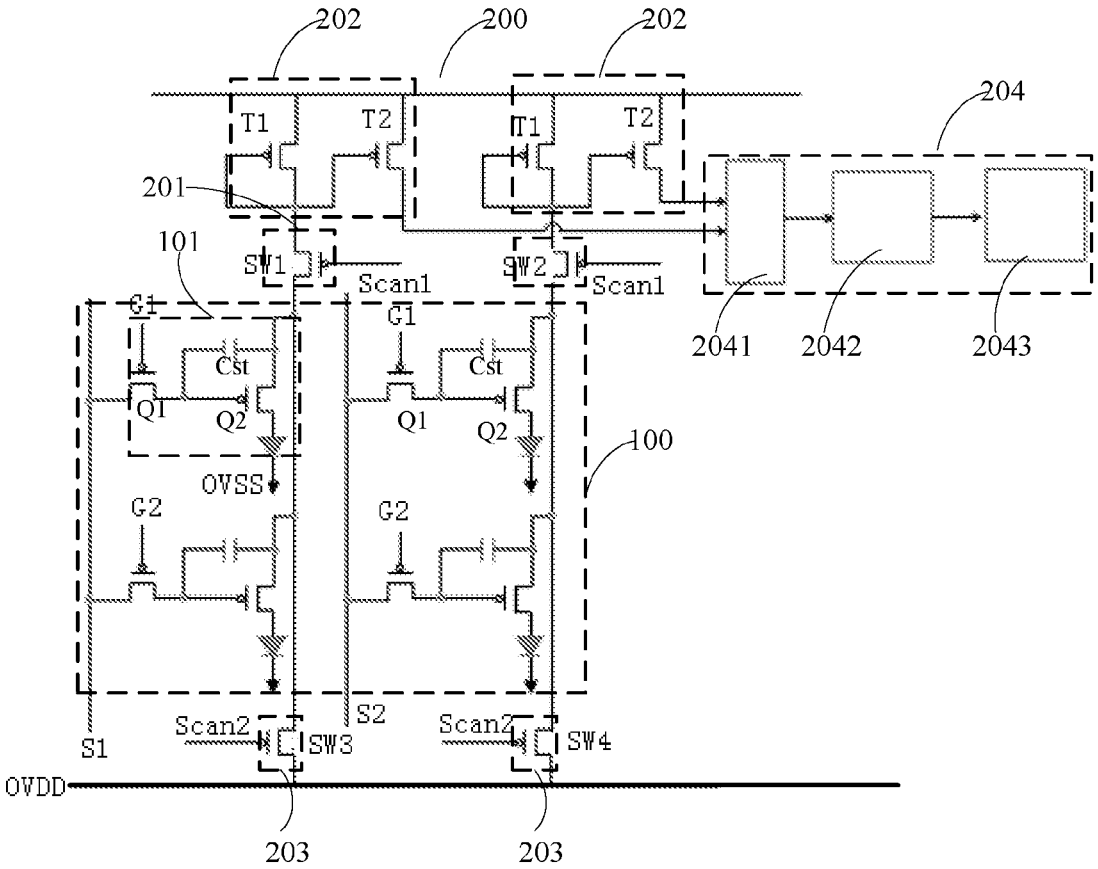
FIG. 1 is a circuit diagram of an OLED display circuit according to an embodiment of the present invention.

The following describes in detail implementations of the present invention. Examples of the implementations are shown in the accompanying drawings, where reference signs that are the same or similar from beginning to end represent same or similar components or components that have same or similar functions. The following implementations described with reference to the accompanying drawings are exemplary, which are used merely to explain the present invention, and cannot be construed as a limit to the present invention.

In the descriptions of the present invention, it should be understood that orientations or position relationships indicated by terms such as "center", "longitudinal", "lateral", "length", "width", "thickness", "above", "below", "front", "rear", "left", "right", "vertical", "horizontal", "top", "bottom", "inside", "outside", "clockwise", and "anticlockwise" are orientations or position relationships indicated based on the accompanying drawings, and are used merely for ease of describing the present invention and of simplified descriptions rather than for indicating or implying that an apparatus or a component needs to have a particular orientation or needs to be constructed or operated in a particular orientation, and therefore, cannot be construed as a limit to the present invention. In addition, terms "first" and "second" are used merely for the purpose of description, and shall not be construed as indicating or implying relative importance or implying a quantity of indicated technical features. Therefore, a feature restricted by "first" or "second" may explicitly indicate or implicitly include one or more such features. In the descriptions of the present invention, unless otherwise explicitly specified, "multiple" means two or more than two.

In the description of the present invention, it should be noted that, unless otherwise explicitly stipulated and restricted, terms "installation", "joint connection", and "connection" should be understood broadly, which, for example, may be a fixed connection, or may be a detachable connection, or an integral connection; or may be a mechanical connection, or may be an electrical connection, or may be mutual communication; or may be a direct connection, or may be an indirect connection by using a medium, or may be an internal communication between two components, or may be an interactive relationship between two components. A person of ordinary skill in the art can understand specific meanings of the foregoing terms in the present invention according to a specific situation.

In the present invention, unless otherwise explicitly stipulated and restricted, that a first feature is "on" or "under" a second feature may include that the first and second features are in direct contact, or may include that the first and second features are not in direct contact but in contact by using other features therebetween. In addition, that the first feature is "on", "above", or "over" the second feature includes that the first feature is right above and on the inclined top of the second feature or merely indicates that a level of the first feature is higher than that of the second feature. That the first feature is "below", "under", or "beneath" the second feature includes that the first feature is right below and at the inclined bottom of the second feature or merely indicates that a level of the first feature is lower than that of the second feature.

Many different implementations or examples are provided in the following disclosure to implement different structures of the present invention. To simplify the disclosure of the present invention, components and settings in particular examples are described below. Certainly, they are merely examples and are not intended to limit the present invention. In addition, in the present invention, reference numerals and/or reference letters may be repeated in different examples. The repetition is for the purposes of simplification and clearness, and a relationship between various discussed implementations and settings is not indicated. Moreover, the present invention provides examples of various particular processes and materials, but a person of ordinary skill in the art may be aware of application of another process and/or use of another material.

Referring to FIG. 1, FIG. 1 shows an OLED display circuit in an embodiment of the present invention. The OLED display circuit includes an OLED display unit 100, multiple data lines S1/S2, multiple scanning lines G1/G2, and a driving compensation circuit 200 for an OLED display unit.

The OLED display unit includes M rows and N columns of pixel units 101, for example, two rows and two columns in this embodiment, where M and N are both positive integers. Each column of pixel units 101 is connected to a data line, and each row of pixel units 101 is connected to a scanning line.

In some embodiments, the driving compensation circuit 200 for an OLED display unit includes N first switching transistors 201, N second switching transistors 203, N sensing units 202 and a calculation and processing unit 204.

An input end of each first switching transistor 201 is connected to a voltage input end of each pixel unit 101 in a column of pixel units 101.

An output end of each second switching transistor 203 is connected to a voltage input end of each pixel unit 101 in a column of pixel units 101.

The N sensing units 202 are connected to the output ends of the N first switching transistors 201 in a one-to-one corresponding manner. The sensing unit 202 is configured to acquire current information of a voltage input end of each pixel unit 101, and is specifically configured to acquire first current information in sensing mode and second current information in display mode that are of the voltage input end of each pixel unit.

The calculation and processing unit 204 is connected to the N sensing units 202. The calculation and processing unit 204 is configured to calculate a mapping relationship between a data voltage of the data line and the current information, and to calculate a data compensation voltage in a display phase according to the second current information and the mapping relationship.

On/off states of a first switching transistor and a second switching transistor that are connected to a same column of pixel units are opposite.

Specifically, each sensing unit 202 includes a first PMOS transistor T1 and a second PMOS transistor T2. A source of the first PMOS transistor T1 is connected to an output end 201 of a corresponding first switching transistor. A gate of the first PMOS transistor T1 is connected to the source of the first PMOS transistor T1. A gate of the second PMOS transistor T2 is connected to the gate of the first PMOS transistor T1. Drains of the first PMOS transistor T1 and the second PMOS transistor T2 are connected to a power supply end. A source of the second PMOS transistor T2 is connected to the calculation and processing unit 204.

In some embodiments, the calculation and processing unit 204 includes a gating module 2041, an analog to digital converter 2042, and a processing chip 2043. An input end of the gating module 2041 is connected to the sensing units 202. An output end of the gating module 2041 is connected to the analog to digital converter 2042. The analog to digital converter 2042 is connected to the processing chip 2043.

In the driving compensation circuit for an OLED display unit in the present invention, the first switching transistor 201 and the second switching transistor 203 are both PMOS transistors.

Figure 2:
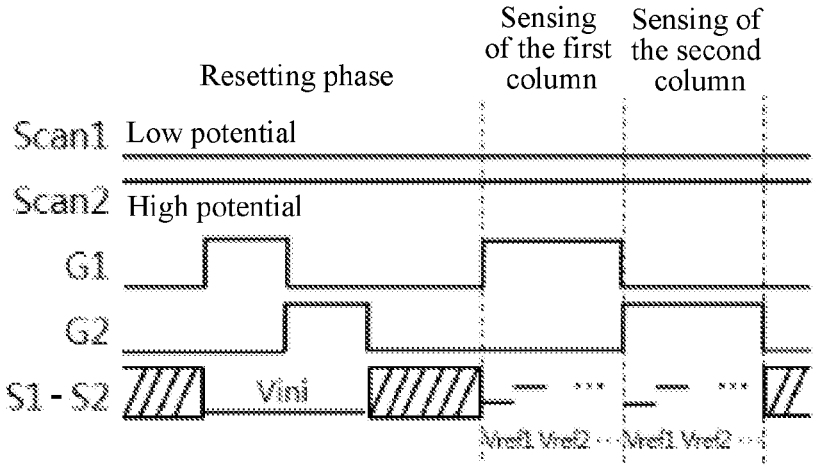
FIG. 2 is a timing diagram of some nodes in an OLED display circuit according to an embodiment of the present invention.

Referring to FIG. 2, the OLED display circuit is operable in the sensing mode and the display mode. In the sensing mode, a mapping relationship between the first current information and a data voltage of each pixel unit 101 is mainly calculated and generated. In the display mode, voltage compensation is performed on each pixel unit 101 according to the mapping relationship and the detected second current information, so that display quality of the OLED display circuit is better.

In a sensing phase, Scan2 is at a high level, and an SW3 and an SW4 in the second switching transistors 203 are turned off. Scan1 is at a low level, and an SW1 and an SW2 in the first switching transistor 201 are turned on.

A: When an $N^{th}$ column of pixel units 101 is sensed, a thin film transistor Q2 of the $N^{th}$ column of pixel units 101 is turned on, a source driver outputs a potential Vref1, and the gating module sequentially conducts the sensing units to the analog to digital converter. The analog to digital converter includes a sample-and-hold circuit, and converts a current into a digital signal to obtain an input current and a compensation voltage of each pixel unit in the $N^{th}$ column of pixel units.

B: An output potential of the source driver is adjusted, and the step A is repeatedly executed to obtain multiple groups of input currents and compensation voltages of each pixel unit in the $N^{th}$ column of pixel units. A mapping relationship between an input current and a compensation voltage is obtained according to the multiple groups of input currents and compensation voltages.

C: An erasure phase: the thin film transistor Q2 of the $N^{th}$ column of pixel units 101 is turned on, and the source driver outputs a low potential Vini, so that a black frame is displayed at the column.

A compensation mapping relationship may be obtained by using the following method: establishing a relationship between an input current value I and a compensation voltage Vref that are sensed, where each pixel unit has two or more than two groups of correspondences, and during compensation, curve fitting is performed to calculate a compensation voltage.

The steps A to C are repeated, and all columns of pixel units 101 in a panel are sensed, to obtain a mapping relationship between current information and a data voltage that correspond to each pixel unit.

In the display mode, the first switching transistors 201 are all in a cut-off state, and the second switching transistors 203 are all in a conducted state; and the compensation unit 204 outputs a compensated voltage to the power input end.

Certainly, in some embodiments, the first switching transistor 201 and the second switching transistor 203 are both NMOS transistors.

The driving compensation circuit for an OLED display unit further includes a gate control unit. The gate control unit is connected to gates of the first switching transistor 201 and the second switching transistor 203, to control the on/off states of the first switching transistor 201 and the second switching transistor 203.

An embodiment of the present invention further provides an OLED display, including the OLED display circuit in the foregoing embodiment.

According to the driving compensation circuit for an OLED display unit, the OLED display circuit, and the OLED display that are provided in the present invention, a mapping relationship between a voltage compensation value to be output to each pixel unit and an input current value is calculated, to compensate for each pixel unit, so that uniformity of the OLED display can be improved.

The compensation circuit provided in the embodiments of the present invention is described in detail above. Specific cases are used in this specification for describing principles and implementations of the present invention. The descriptions of the embodiments are merely for ease of understanding the present invention. Meanwhile, a person skilled in the art may make modifications in terms of the specific implementations and application scopes according to the idea of the present invention. In conclusion, the content of this specification should not be construed as a limit to the present invention.

What is claimed is:

1. A driving compensation circuit for an organic light-emitting diode (OLED) display unit, wherein the OLED display unit comprises M rows and N columns of pixel units, wherein each column of pixel units is connected to a data line, and each row of pixel units is connected to a scanning line; and the compensation circuit comprises:

N first switching transistors, each first switching transistor comprising an input end connected to a voltage input end of each pixel unit in a column of pixel units, wherein N is a positive integer;

N second switching transistors, each second switching transistor comprising an output end connected to a voltage input end of each pixel unit in a column of pixel units;

N sensing units, connected to the output ends of the N first switching transistors in a one-to-one corresponding manner, and configured to acquire first current information in sensing mode and second current information in display mode that are of a voltage input end of each pixel unit; and a calculation and processing unit, connected to the N sensing units and the data line, and configured to calculate a mapping relationship between a data voltage of the data line and the first current information, and to calculate a data compensation voltage in a display phase according to the second current information and the mapping relationship, wherein on/off states of a first switching transistor and a second switching transistor that are connected to a same column of pixel units are opposite;

wherein the sensing unit comprises a first PMOS transistor and a second PMOS transistor; a source of the first PMOS transistor is connected to an output end of a corresponding first switching transistor; a gate of the first PMOS transistor is connected to the source of the first PMOS transistor; a gate of the second PMOS transistor is connected to the gate of the first PMOS transistor; drains of the first PMOS transistor and the second PMOS transistor are connected to a power supply end; and a source of the second PMOS transistor is connected to the calculation and processing unit; and the calculation and processing unit comprises a gating module, an analog to digital converter, and a processing chip; an input end of the gating module is connected to the sensing units; an output end of the gating module is connected to the analog to digital converter; and the analog to digital converter is connected to the processing chip.

2. The driving compensation circuit for an OLED display unit according to claim 1, wherein, in the sensing mode, the first switching transistors are all in a conducted state, and the second switching transistors are all in a cut-off state; the gating module sequentially conducts the sensing units to the analog to digital converter; the analog to digital converter converts the first current information into a digital signal; and the processing chip calculates a mapping relationship between a voltage compensation value and a current value according to the digital signal.

3. The driving compensation circuit for an OLED display unit according to claim 1, wherein, in the display mode, the first switching transistors are all in a cut-off state, and the second switching transistors are all in a conducted state; and the compensation unit outputs a compensated voltage to the power input end.

4. The driving compensation circuit for an OLED display unit according to claim 1, wherein the first switching transistor and the second switching transistor are both PMOS transistors.

5. The driving compensation circuit for an OLED display unit according to claim 1, wherein the first switching transistor and the second switching transistor are both NMOS transistors.

6. The driving compensation circuit for an OLED display unit according to claim 1, further comprising a gate control unit, wherein the gate control unit is connected to gates of the first switching transistor and the second switching transistor, to control on/off states of the first switching transistor and the second switching transistor.

7. A driving compensation circuit for an organic light-emitting diode (OLED) display unit, wherein the OLED display unit comprises M rows and N columns of pixel units, wherein each column of pixel units is connected to a data line, and each row of pixel units is connected to a scanning line; and the compensation circuit comprises:

N first switching transistors, each first switching transistor comprising an input end connected to a voltage input end of each pixel unit in a column of pixel units, wherein N is a positive integer;

N second switching transistors, each second switching transistor comprising an output end connected to a voltage input end of each pixel unit in a column of pixel units;

N sensing units, connected to the output ends of the N first switching transistors in a one-to-one corresponding manner, and configured to acquire first current information in sensing mode and second current information in display mode that are of a voltage input end of each pixel unit; and a calculation and processing unit, connected to the N sensing units, and the data line, and configured to calculate a mapping relationship between a data voltage of the data line and the first current information, and to calculate a data compensation voltage in a display phase according to the second current information and the mapping relationship, wherein on/off states of a first switching transistor and a second switching transistor that are connected to a same column of pixel units are opposite.

8. The driving compensation circuit for an OLED display unit according to claim 7, wherein the sensing unit comprises a first PMOS transistor and a second PMOS transistor; a source of the first PMOS transistor is connected to an output end of a corresponding first switching transistor; a gate of the first PMOS transistor is connected to the source of the first PMOS transistor; a gate of the second PMOS transistor is connected to the gate of the first PMOS transistor; drains of the first PMOS transistor and the second PMOS transistor are connected to a power supply end; and a source of the second PMOS transistor is connected to the calculation and processing unit.

9. The driving compensation circuit for an OLED display unit according to claim 7, wherein the calculation and processing unit comprises a gating module, an analog to digital converter, and a processing chip; an input end of the gating module is connected to the sensing units; an output end of the gating module is connected to the analog to digital converter; and the analog to digital converter is connected to the processing chip.

10. The driving compensation circuit for an OLED display unit according to claim 9, wherein, in the sensing mode, the first switching transistors are all in a conducted state, and the second switching transistors are all in a cut-off state; the gating module sequentially conducts the sensing units to the analog to digital converter; the analog to digital converter converts the first current information into a digital signal; and the processing chip calculates a mapping relationship between a voltage compensation value and a current value according to the digital signal.

11. The driving compensation circuit for an OLED display unit according to claim 9, wherein, in the display mode, the first switching transistors are all in a cut-off state, and the second switching transistors are all in a conducted state; and the compensation unit outputs a compensated voltage to the power input end.

12. The driving compensation circuit for an OLED display unit according to claim 7, wherein the first switching transistor and the second switching transistor are both PMOS transistors.

13. The driving compensation circuit for an OLED display unit according to claim 7, wherein the first switching transistor and the second switching transistor are both NMOS transistors.

14. The driving compensation circuit for an OLED display unit according to claim 7, further comprising a gate control unit, wherein the gate control unit is connected to gates of the first switching transistor and the second switching transistor, to control on/off states of the first switching transistor and the second switching transistor.

15. An organic light-emitting diode (OLED) circuit, comprising a driving compensation circuit for an OLED display unit, wherein the OLED display unit comprises M rows and N columns of pixel units, wherein each column of pixel units is connected to a data line, and each row of pixel units is connected to a scanning line; and the compensation circuit comprises:

N first switching transistors, each first switching transistor comprising an input end connected to a voltage input end of each pixel unit in a column of pixel units, where N is a positive integer;

N second switching transistors, each second switching transistor comprising an output end connected to a voltage input end of each pixel unit in a column of pixel units;

N sensing units, wherein the N sensing units are connected to the output ends of the N first switching transistors in a one-to-one corresponding manner, and configured to acquire first current information in sensing mode and second current information in display mode that are of a voltage input end of each pixel unit; and a calculation and processing unit, connected to the N sensing units, and the data line, and configured to calculate a mapping relationship between a data voltage of the data line and the first current information, and to calculate a data compensation voltage in a display phase according to the second current information and the mapping relationship, wherein on/off states of a first switching transistor and a second switching transistor that are connected to a same column of pixel units are opposite.

16. The driving compensation circuit for an OLED display unit according to claim 15, wherein the sensing unit comprises a first PMOS transistor and a second PMOS transistor; a source of the first PMOS transistor is connected to an output end of a corresponding first switching transistor; a gate of the first PMOS transistor is connected to the source of the first PMOS transistor; a gate of the second PMOS transistor is connected to the gate of the first PMOS transistor; drains of the first PMOS transistor and the second PMOS transistor are connected to a power supply end; and a source of the second PMOS transistor is connected to the calculation and processing unit.

17. The driving compensation circuit for an OLED display unit according to claim 15, wherein the calculation and processing unit comprises a gating module, an analog to digital converter, and a processing chip; an input end of the gating module is connected to the sensing units; an output end of the gating module is connected to the analog to digital converter; and the analog to digital converter is connected to the processing chip.

18. The driving compensation circuit for an OLED display unit according to claim 17, wherein, in the sensing mode, the first switching transistors are all in a conducted state, and the second switching transistors are all in a cut-off state; the gating module sequentially conducts the sensing units to the analog to digital converter; the analog to digital converter converts the first current information into a digital signal; and the processing chip calculates a mapping relationship between a voltage compensation value and a current value according to the digital signal.

19. The driving compensation circuit for an OLED display unit according to claim 17, wherein, in the display mode, the first switching transistors are all in a cut-off state, and the second switching transistors are all in a conducted state; and the compensation unit outputs a compensated voltage to the power input end.

20. The driving compensation circuit for an OLED display unit according to claim 15, wherein the first switching transistor and the second switching transistor are both PMOS transistors.

* * * * *